US008673093B2

(12) United States Patent
Ikeda et al.

(10) Patent No.: US 8,673,093 B2
(45) **Date of Patent: *Mar. 18, 2014**

(54) HIGH-STRENGTH THIN STEEL SHEET

(75) Inventors: Muneaki Ikeda, Kakogawa (JP); Kouji Kasuya, Kakogawa (JP); Yoichi Mukai, Kakogawa (JP); Fumio Yuse, Kobe (JP); Junichiro Kinugasa, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 309 days.

This patent is subject to a terminal disclaimer.

(21) Appl. No.: 12/513,514

(22) PCT Filed: Dec. 10, 2007

(86) PCT No.: PCT/JP2007/073791

§ 371 (c)(1),
(2), (4) Date: May 5, 2009

(87) PCT Pub. No.: WO2008/072600

PCT Pub. Date: Jun. 19, 2008

(65) Prior Publication Data

US 2010/0080728 A1 Apr. 1, 2010

(30) Foreign Application Priority Data

Dec. 11, 2006 (JP) ..... 2006-333797

(51) Int. Cl.

| | |
|---|---|
| ***C22C 38/14*** | (2006.01) |
| ***C22C 38/02*** | (2006.01) |
| ***C22C 38/04*** | (2006.01) |
| ***C21D 9/00*** | (2006.01) |

(52) U.S. Cl.
USPC ..... 148/330; 148/334; 148/335; 148/336; 148/602; 148/648

(58) Field of Classification Search
USPC ..... 148/320, 328, 330–336, 654, 602, 648, 148/650; 420/121, 104–114
See application file for complete search history.

(56) References Cited

U.S. PATENT DOCUMENTS

2006/0137768 A1 6/2006 Yuse et al.

FOREIGN PATENT DOCUMENTS

| | | | |
|---|---|---|---|
| CN | 101351570 | A | 1/2009 |
| EP | 0 997 548 | A1 | 5/2000 |
| EP | 1 589 126 | A1 | 10/2005 |
| EP | 1 676 933 | A1 | 7/2006 |
| EP | 1 975 266 | A1 | 10/2008 |

(Continued)

OTHER PUBLICATIONS

Machine-English translation of Japanese patent 2004-332099, Usami Akira, Nov. 25, 2004.*

(Continued)

*Primary Examiner* — Deborah Yee
(74) *Attorney, Agent, or Firm* — Oblon, Spivak, McClelland, Maier & Neustadt, L.L.P.

(57) ABSTRACT

The present invention is the thin steel sheet containing C, Si, Mn, P, S, Al, Mo, Ti, B, and N wherein a value Z calculated by the equation described below is 2.0-6.0, an area ratio against all the structure is 1% or above for retained austenite and 80% or above for total of bainitic ferrite and martensite, a mean axis ratio of the retained austenite crystal grain is 5 or above, and tensile strength is 980 MPa or above where Value Z=9×[C]+[Mn]+3×[Mo]+490×[B]+7×[Mo]/{100×([B]+0.001),and the thin steel sheet has 980 MPa or above tensile strength and enhanced hydrogen embrittlement resistance properties.

8 Claims, 1 Drawing Sheet

(56) References Cited

FOREIGN PATENT DOCUMENTS

| | | |
|---|---|---|
| JP | 2003 193193 | 7/2003 |
| JP | 2005 97725 | 4/2005 |
| JP | 2006 207016 | 8/2006 |
| JP | 2006 207017 | 8/2006 |
| JP | 2006 207018 | 8/2006 |

OTHER PUBLICATIONS

Machine-English translation of Japanese patent 2006-207018, Yuse Fumio et al., Aug. 10, 2006.*
U.S. Appl. No. 12/610,727, filed Nov. 2, 2009, Ikeda, et al.
U.S. Appl. No. 13/635,696, filed Sep. 18, 2012, Ikeda, et al.

* cited by examiner (a)
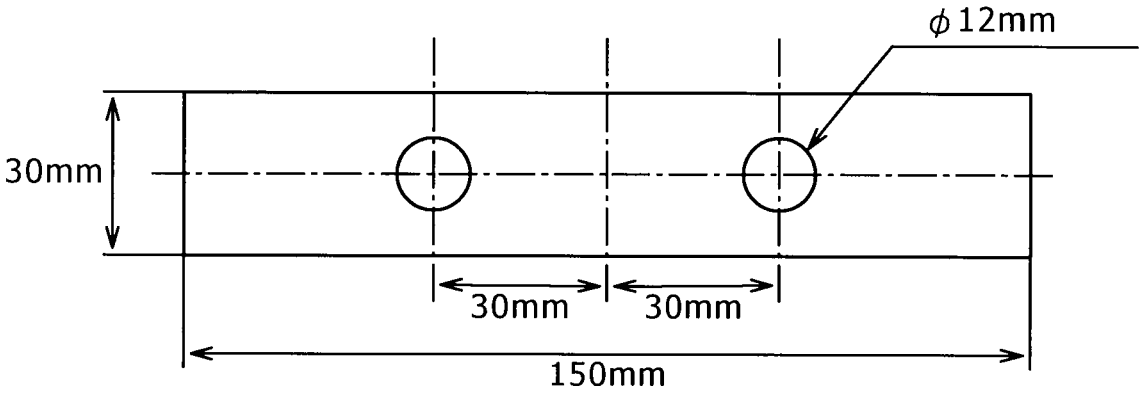
(b)
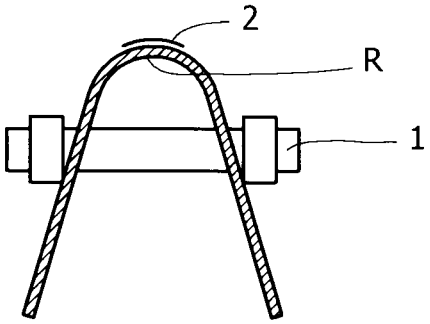

HIGH-STRENGTH THIN STEEL SHEET

TECHNICAL FIELD

The present invention relates to a high strength thin steel sheet excellent in hydrogen embrittlement resistance properties and, in particular, relates to a high strength thin steel sheet inhibiting breakage attributable to hydrogen embrittlement such as season cracking and delayed fracture which become a problem in a steel sheet with 980 MPa or above tensile strength.

BACKGROUND ART

In obtaining high strength parts constituting an automobile and the like by press forming work and bending work, a steel sheet used for such work is required to have both excellent strength and ductility. In recent years, in order to make the automobile light in weight and to realize low fuel consumption, it is desired to enhance the strength of the steel sheet used as a material for automobiles, to make the sheet thickness even thinner, and to realize light weight. Also, in order to improve safety performance against a collision of automobiles, further high strengthening is required for structural parts for automobiles such as a pillar and the like, and application of a high strength thin steel sheet with 980 MPa or above tensile strength is under investigation.

As a steel sheet having both high strength and ductility, a TRIP (Transformation Induced Plasticity) steel sheet is being watched. The TRIP steel sheet is a steel sheet wherein austenite structure is retained in steel, and in work deformation at a temperature of martensite deformation starting temperature (Ms point) or above, retained austenite (retained γ) is inductively transformed to martensite due to stress, and thereby large elongation can be obtained. Several kinds of it can be cited, and (1) a TRIP type composite structure steel with a base phase of polygonal ferrite and including retained austenite (TPF steel), (2) a TRIP type tempered martensite steel with a base phase of tempered martensite and including retained austenite (TAM steel), (3) a TRIP type bainite steel with a base phase of bainitic ferrite and including retained austenite (TBF steel), and the like are exemplarily known.

Out of them, the TBF steel has been known since long time ago, wherein high strength can be easily obtained because of hard bainitic ferrite, fine retained austenite is easily formed in the boundary of lath-like bainitic ferrite, and such structural form brings outstandingly excellent elongation. Also, the TBF steel has a merit in manufacturing that easy manufacturing is possible by one time heat treatment (a continuous annealing step or a plating step).

However, in the high strength region of 980 MPa or above tensile strength, it is known that a harmful effect of delayed fracture due to hydrogen embrittlement newly occurs as the time elapses. Delayed fracture is a phenomenon that, in high strength steel, hydrogen generated from the corrosive environment or atmosphere diffuses into a and a hollow hole in steel and defect portion in a grain boundary or the like, the material is embrittled, stress is applied under this condition, and thereby breakage is caused. The delayed fracture causes a harmful effect such as deterioration of ductility and toughness of metallic materials.

So, the present inventors proposed a TRIP type ultra high strength thin steel sheet with high strength and improved hydrogen embrittlement resistance properties without damaging excellent ductility which is a feature of the TRIP steel sheet in the gazettes of the Japanese Unexamined Patent Application Publication No. 2006-207016, the Japanese Unexamined Patent Application Publication No. 2006-207017, and the Japanese Unexamined Patent Application Publication No. 2006-207018. Here, Mo-added steel added with Mo more preferably by 0.1% or above in order to improve mainly hydrogen embrittlement resistance properties is used.

DISCLOSURE OF THE INVENTION

The present invention was developed based on such situation, and its object is to provide a high strength thin steel sheet with 980 MPa or above tensile strength and improved hydrogen embrittlement resistance properties. Also, another object of the present invention is to provide a hot-rolled steel sheet with improved cold-rollability, which is a hot-rolled steel sheet for cold-rolling capable of manufacturing the high strength thin steel sheet described above with good productivity.

A high strength thin steel sheet in relation with the present invention that could solve the problems described above is a thin steel sheet satisfying, in mass %, C: 0.10-0.25%, Si: 0.5-3%, Mn: 1.0-3.2%, P: 0.1% or below, S: 0.05% or below, Al: 0.01-0.1%, Mo: 0.02% or below, Ti: 0.005-0.1%, B: 0.0002-0.0030%, N: 0.01% or below, balance consisting of iron with inevitable impurities, wherein the thin steel sheet is characterized that a value Z calculated by an equation (1) below is 2.0-6.0, an area ratio against all the structure is 1% or above for retained austenite and 80% or above for total of bainitic ferrite and martensite, a mean axis ratio (major axis/minor axis) of the retained austenite crystal grain is 5 or above, and tensile strength is 980 MPa or above. In the equation, [ ] represents content (mass %) of the respective elements contained in the thin steel sheet.

$$\text{Value } Z=9\times[C]+[Mn]+3\times[Mo]+490\times[B]+7\times[Mo]/\{100\times([B]+0.001)\} \quad (1)$$

Also, a hot-rolled steel sheet for cold-rolling in relation with the present invention that could solve the problems described above is a hot-rolled steel sheet for cold-rolling satisfying, in mass %, C: 0.10-0.25%, Si: 0.5-3%, Mn: 1.0-3.2%, P: 0.1% or below, S: 0.05% or below, Al: 0.01-0.1%, Mo: 0.02% or below, Ti: 0.005-0.1%, B: 0.0002-0.0030%, N: 0.01% or below, balance consisting of iron with inevitable impurities, wherein the hot-rolled steel sheet is characterized that the value Z calculated by an equation (1) below is 2.0-6.0, and the tensile strength is 900 MPa or below. In the equation, [ ] represents content (mass %) of the respective elements contained in the hot-rolled steel sheet.

$$\text{Value } Z=9\times[C]+[Mn]+3\times[Mo]+490\times[B]+7\times[Mo]/\{100\times([B]+0.001)\} \quad (1)$$

The high strength thin steel sheet described above and the hot-rolled steel sheet for cold-rolling described above may further contain, as other elements, (a) at least one kind of elements selected from a group consisting of Nb: 0.005-0.1%, V: 0.01-0.5%, and Cr: 0.01-0.5%, (b) at least either one element of Cu: 0.01-1% and Ni: 0.01-1%, (c) W: 0.01-1%, (d) at least one kind of elements selected from a group consisting of Ca: 0.0005-0.005%, Mg: 0.0005-0.005%, and REM: 0.0005-0.005%, or the like.

The hot-rolled steel sheet for cold-rolling of the present invention can be manufactured by hot-rolling of a slab satisfying the componential composition described above and coiling it at 550-800° C.

In accordance with the present invention, because the componential composition of the hot-rolled steel sheet is appropriately controlled, the tensile strength of the hot-rolled steel sheet can be inhibited to 900 MPa or below, and cold-rollability can be improved. Consequently, if an appropriate heat treatment is conducted after cold-rolling of the hot-rolled steel sheet, the TRIP type high strength steel sheet (high strength cold-rolled thin steel sheet) can be manufactured with good productivity. In the high strength thin steel sheet of the present invention, the tensile strength can be enhanced to 980 MPa or above, and hydrogen infiltrating in from the outside can be made harmless, and thereby hydrogen embrittlement resistance properties can be improved.

BRIEF DESCRIPTION OF THE DRAWINGS

FIG. 1 A drawing for explanation of an evaluation method of hydrogen embrittlement resistance properties, where, (a) is a schematic view of a test piece, and (b) is a drawing showing a shape of the test piece under evaluation.

BEST MODE FOR CARRYING OUT THE INVENTION

Continuously after the technology described in the gazette of the Japanese Unexamined Patent Application Publication No. 2006-207016 was proposed, the present inventors have made intensive investigations in order to improve productivity of the ultra high strength thin steel sheet while minimizing deterioration of strength and hydrogen embrittlement resistance properties. As the result of it, (1) that, if Mo non-addition steel inhibiting Mo to 0.02% or below was used and the value Z represented by the balance between Mo and B was adjusted appropriately, the tensile strength of the hot-rolled steel sheet whose tensile strength had conventionally exceeded 900 MPa could be lowered to 900 MPa or below, and cold-rollability could be improved, (2) that, if the cold-rolled steel sheet obtained by cold-rolling of this hot-rolled steel sheet was subjected to heat treatment under the condition disclosed in the gazette of the Japanese Unexamined Patent Application Publication No. 2006-207016, the tensile strength could be improved to 980 MPa or above, and high strengthening could be realized, (3) and that the high strength thin steel sheet obtained by the heat treatment could achieve hydrogen embrittlement resistance properties of the same level as that for the ultra high strength thin steel sheet proposed in the gazette of the Japanese Unexamined Patent Application Publication No. 2006-207016, were found out, and the present invention was completed. Below, the present invention will be described in detail.

First, a hot-rolled steel sheet for cold-rolling suitable for obtaining the high strength thin steel sheet of the present invention will be described. In the present specification, a high strength thin steel sheet and a hot-rolled steel sheet for cold-rolling are in the relation of a final product and an intermediate. Hereinafter, the high strength thin steel sheet and the hot-rolled steel sheet for cold-rolling may collectively be referred to simply as the "steel sheet".

The hot-rolled steel sheet of the present invention is characterized that the componential composition is controlled in order to improve mainly cold-rollability, and it is important that B is contained in the range of 0.0002-0.0030% while Mo is reduced to 0.02% or below, and the value Z calculated by the equation (1) described below from the content of Mo, B, C and Mn is adjusted to the range of 2.0-6.0. In the present specification, the steel wherein Mo is reduced to 0.02% or below (inclusive of 0%), in particular, is referred to as "Mo non-addition steel" for facilitating explanation.

$$\text{Value } Z = 9\times[C]+[Mn]+3\times[Mo]+490\times[B]+7\times[Mo]/\{100\times([B]+0.001)\} \quad (1)$$

The value Z represented by the equation (1) described above is a parameter defined mainly in order to improve cold-rollability of the hot-rolled steel sheet and to secure the strength of the thin steel sheet obtained using the hot-rolled steel sheet concerned. More specifically, if the value Z is adjusted to the range of 2.0-6.0, the tensile strength of the hot-rolled steel sheet can be inhibited to 900 MPa or below and cold-rolling can be performed with excellent productivity, while, if the cold-rolled steel sheet obtained is subjected to an appropriate heat treatment, it is quenched sufficiently and the high strength thin steel sheet provided with the tensile strength of 980 MPa or above can be obtained. Further, the upper limit of the value Z is determined from a viewpoint of cold-rollability of the hot-rolled steel sheet, and the lower limit of the value Z is determined from a viewpoint of the strength of the thin steel sheet.

The value Z described above represents the balance of the elements contributing to quenchability (C, Mn, Mo, B) and is a value obtained by repetition of a variety of experiments. In particular, 9×[C], [Mn], 3×[Mo], 490×[B] in the equation (1) described above represent the degree of an influence of the respective elements on the strength of the thin steel sheet (degree of contribution). On the other hand, 7×[Mo]/{100×([B]+0.001)} in the equation (1) described above is the one stipulated based on the balance of Mo which contributes to high strengthening of the thin steel sheet while having an action of enhancing the strength of the hot-rolled steel sheet and impeding cold-rollability, and B which has an action of inhibiting increase of the strength of the hot-rolled steel sheet and enhancing the strength of the thin steel sheet without impeding cold-rollability compared with Mo.

If the value Z described above exceeds 6.0, the balance of the quenchability improving elements is deteriorated, the strength of the hot-rolled steel sheet becomes excessively high, and cold-rollability deteriorates. Accordingly, contents of the respective elements are adjusted so that the value Z becomes 6.0 or below, preferably 5.9 or below, more preferably 5.8 or below. If viewed from the point of cold-rollability only, the value Z preferably is as little as possible, however, if the value Z is below 2.0, quenchability is insufficient and the strength as the thin steel sheet cannot be secured. Accordingly, contents of the respective elements are adjusted so that the value Z becomes 2.0 or above, preferably 3.0 or above, more preferably 4.0 or above.

Next, the respective elements constituting the value Z will be described. Mo is a quenchability improving element, and, by containing Mo, Mo precipitates as fine carbide, and contributes to high strengthening of the thin steel sheet by precipitation strengthening. Also, because the precipitated carbide acts as a hydrogen trap site, it exerts the effect of inhibiting delayed fracture by hydrogen embrittlement. According to the gazette of the Japanese Unexamined Patent Application Publication No. 2006-207016 described above, Mo is positively added with the aim of such improvement of a high strengthening action and hydrogen embrittlement resistance properties by Mo.

On the other hand, it was found out by later investigation of the present inventors that, when Mo-added steel containing much Mo is used, a hard phase (bainite and martensite, for example) is formed at the time of hot-rolling, the strength of the hot-rolled steel sheet becomes extremely high, and cold-rollability in cold-rolling after hot-rolling is deteriorated. Consequently, in order to improve cold-rollability of the ultra high strength thin steel sheet using Mo-added steel, it is favorable that Mo is not added to the best. However, as described above, Mo is effective as a quenchability improving element, and if adding of Mo is made zero simply, quenchability is deteriorated and the strength required for the thin steel sheet finally obtained cannot be secured sufficiently. Therefore, in manufacturing the ultra high strength thin steel sheet using Mo-added steel, in order to improve cold-rollability, such a method that tempering is performed after hot-rolling, dislocation density in bainite is lowered, and martensite is converted to mixed structure of soft ferrite and cementite, and so on, and thereby cold-rollability is improved, for example, is adopted, which brings deterioration of productivity such as necessity of tempering treatment before cold-rolling after hot-rolling.

So, in the present invention, from the viewpoint of securing the high strength of the thin steel sheet finally obtained while mainly improving cold-rollability of the hot-rolled steel sheet, it was decided to contain B by a specific amount as an element alternate to Mo. It was newly revealed this time that B had an effect to promote pearlite transformation more compared with Mo. The conventional Mo-added steel is highly strengthened as pearlite transformation is not finished in the cooling step after hot rolling and coiling and martensite is formed by containing B instead of Mo, pearlite transformation is promoted, and formation of martensite can be inhibited. Thus, the structure can become mainly of ferrite and pearlite, and inhibition of increase of the strength of the hot-rolled steel sheet becomes possible.

Also, in the present invention, lowering of hydrogen embrittlement resistance properties accompanying decrease of Mo was also worried as described above, however, it was revealed that hydrogen embrittlement resistance properties could be improved by containing B by a specific amount. The mechanism of being able to improve hydrogen embrittlement resistance properties is not known, but it is presumed that, because solubility of B into austenite is low, B segregates in the austenite grain boundary and enhances bonding power between grain boundaries, and thereby hydrogen embrittlement becomes hard to occur.

The content of Mo is to be made 0.02% or below, preferably 0.015% or below, more preferably 0.01% or below. It is favorable that Mo is as little as possible, and is most preferably 0%.

On the other hand, the content of B is to be made 0.0002-0.0030%. If B is below 0.0002%, quenching cannot be performed sufficiently and the strength of the obtained thin steel sheet is insufficient. Therefore, Bis to be 0.0002% or above, preferably 0.0005% or above. However, if B is contained excessively, hot workability is deteriorated. Also, because borocarbides precipitate in the grain boundary and intergranular embrittlement occurs, desired hydrogen embrittlement resistance properties of the obtained thin steel sheet cannot be secured. Accordingly, B is to be made 0.0030% or below, preferably 0.0025% or below.

In order to exert the cold-rollability enhancing action effectively by addition of B, N in steel is to be reduced and BN is not to be formed to the best. Accordingly, N is to be made 0.01% or below. Also, in order to inhibit generation of BN, in the present invention, Ti, which has higher affinity with N than B, is contained in the range of 0.005-0.1%, and N in steel is trapped as TiN.

N is to be made preferably 0.008% or below, more preferably 0.005% or below. N is preferable to be as little as possible, however, it is not practical to reduce it to 0%, therefore, 0% is not included.

In addition to act to trap N, Ti is an element to promote formation of protective rust similarly to Cu and Ni which will be described later. The protective rust inhibits formation of β-FeOOH which is formed particularly in an environment of chloride and exerts a harmful influence on corrosion resistance (on hydrogen embrittlement resistance properties as a result). Consequently, Ti is to be made 0.005% or above, preferably 0.01% or above, more preferably 0.03% or above. However, if Ti is added excessively, precipitation of carbide, nitride, or carbonitride of Ti becomes much and deterioration of workability and hydrogen embrittlement resistance properties is caused. Therefore, the upper limit of Ti is to be made 0.1%. 0.08% or below is preferable.

In the steel sheet of the present invention, it is important to adjust the balance of the contents of C, Mn, Mo and B so as to satisfy the equation (1) described above, but the contents of C and Mn are as described below.

[C: 0.10-0.25%]

C is an element which secures the strength of the thin steel sheet when it is obtained. In other words, it is an element required for improving quenchability and securing the high strength of 980 MPa or above. Further, it is an important element also for containing sufficient C within an austenite phase and making the desired austenite phase be retained even at room temperature. Because austenite is retained, strength-ductility balance becomes excellent. Also, lath-like stable retained austenite (the detail will be described later) acts as a hydrogen trap site, and improves hydrogen embrittlement resistance properties. From such viewpoint, in the present invention, C is made to contain by 0.10% or above, preferably 0.12% or above, more preferably 0.15% or above. However, if it is contained excessively, the strength becomes too high and hydrogen embrittlement becomes easy to occur. In addition, weldability also deteriorates. Consequently, the upper limit of C is to be made 0.25%. 0.23% or below is preferable, and 0.20% or below is more preferable.

[Mn: 1.0-3.2%]

Mn is an element which acts to stabilize austenite, and is an element required for securing the amount of austenite. Also, Mn is an element to improve quenchability and acts for high strengthening as well. In order to exert such actions, Mn is to be contained by 1.0% or above, preferably 1.2% or above, more preferably 1.5% or above. However, if it is contained excessively, segregation becomes extreme, grain boundary segregation of P is encouraged, and hydrogen embrittlement resistance properties deteriorate due to intergranular embrittlement. Consequently, the upper limit of Mn is to be made 3.2%. 3.0% or below is preferable, and 2.8% or below is more preferable.

The steel sheet of the present invention contains Si and Al as fundamental compositions besides the elements described above, and P and S are suppressed to the range described below.

[Si: 0.5-3%]

Si acts as a solid solution strengthening element and is an important element for securing the strength of the thin steel sheet. Further, Si is an element acting also for inhibiting formation of carbides by decomposition of retained austenite and also for obtaining retained austenite desired. In order to exert such actions, Si is to be contained by 0.5% or above, preferably 0.8% or above, more preferably 1.0% or above. However, if it is contained excessively, scale formation in hot-rolling becomes extreme and acid pickling properties deteriorate. Consequently, the upper limit of Si is to be made 3%. 2.8% or below is preferable, and 2.5% or below is more preferable.

[Al: 0.01-0.1%]

Al is added as a deoxidizing element. In order to exert such action effectively, it is favorable to contain Al by 0.01% or above, preferably 0.02% or above, more preferably 0.03% or above. However, if Al becomes excessive, ductility of the thin steel sheet deteriorates and inclusions such as alumina increase to deteriorate workability, and consequently, Al is to be made 0.1% or below, preferably 0.08% or below, more preferably 0.05% or below.

[P: 0.1% or Below]

Because P is an element encouraging grain boundary fracture due to grain boundary segregation, it is preferable that P is low, and its upper limit is to be made 0.1%. 0.05% or below is preferable, and 0.01% or below is more preferable.

[S: 0.05% or Below]

S is an element encouraging hydrogen absorption of the thin steel sheet under corrosive environment. Also, a sulfide such as MnS is formed within the thin steel sheet and this sulfide becomes the start point of a crack due to hydrogen embrittlement, and therefore, it is preferable that S is low. Consequently, S is to be made 0.05% or below, preferably 0.03% or below, more preferably 0.01% or below.

The fundamental composition in the steel sheet of the present invention is as described above, and the balance is substantially iron, however, inclusion of inevitable impurities brought in according to the situation of raw materials, auxiliary materials, production equipment and the like is allowable.

Further, in the steel sheet of the present invention, besides the compositions described above, (a) at least one kind of elements selected from a group consisting of Nb, V, and Cr, (b) at least one element of Cu and Ni, (c) W, (d) at least one kind of elements selected from a group consisting of Ca, Mg, and REM, may be contained positively in the range described below.

[(a) At Least One Kind Selected from a Group Consisting of Nb: 0.005-0.1%, V: 0.01-0.5%, and Cr: 0.01-0.5%]

Nb, V, Cr are all elements acting very effectively for increasing the strength of the thin steel sheet. In particular, Nb is an element effectively acting for improving toughness by grain-refining of the structure, in addition to increasing the strength of the thin steel sheet. In order to exert such effects effectively, it is recommended to contain Nb by 0.005% or above. 0.01 or above is more preferable, and 0.02% or above is further more preferable. However, even if Nb is excessively contained, these effects saturate which is the economical waste. Also, coarse precipitates are formed and embrittlements occur. Accordingly, Nb is inhibited to 0.1% or below, preferably 0.09% or below, more preferably 0.08% or below.

V is an element effectively acting for improving toughness by grain-refining of the structure in addition to increasing the strength of the thin steel sheet. Also, carbide, nitride, or carbonitride of V acts as a hydrogen trap site and acts also for improving hydrogen embrittlement resistance properties. In order to exert such effects effectively, it is recommended to contain V by 0.01% or above. 0.05% or above is more preferable, and 0.1% or above is furthermore preferable. However, if V is contained excessively, carbide, nitride, or carbonitride of V precipitates excessively causing embrittlement, which deteriorates workability and hydrogen embrittlement resistance properties. Accordingly, V is to be inhibited to 0.5% or below, preferably 0.4% or below, more preferably 0.3% or below.

In addition to increasing the strength of the thin steel sheet, Cr acts for inhibiting infiltration of hydrogen. Also, precipitates containing Cr (carbide and carbonitride of Cr, for example) act as a hydrogen trap site and act for improving hydrogen embrittlement resistance properties. In order to exert such effects effectively, it is recommended to contain Cr by 0.01% or above. 0.05% or above is more preferable, and 0.1% or above is further more preferable. However, if Cr is contained excessively, ductility and workability are deteriorated. Accordingly, Cr is to be inhibited to 0.5% or below, preferably 0.4% or below, more preferably 0.3% or below.

[(b) At Least One of Cu: 0.01-1% and Ni: 0.01-1%]

Cu and Ni are elements acting for inhibiting generation of hydrogen which becomes the cause of hydrogen embrittlement, inhibiting infiltration of the generated hydrogen into the thin steel sheet, and improving hydrogen embrittlement resistance properties. Cu and Ni improve corrosion resistance of the thin steel sheet itself and inhibit generation of hydrogen due to corrosion of the thin steel sheet. Further, Cu an Ni have also an effect of promoting formation of iron oxide ($\alpha$-FeOOH) which is said to be thermodynamically stable and protective among rust formed in the atmospheric air, can inhibit infiltration of the generated hydrogen into the thin steel sheet by realizing promotion of rust formation, and improve hydrogen embrittlement resistance properties under severe corrosive environment.

In order to exert such effects effectively, it is favorable to contain Cu by 0.01 or above, preferably 0.1% or above, more preferably 0.15% or above, furthermore preferably 0.2% or above. It is favorable to contain Ni by 0.01% or above, preferably 0.1% or above, more preferably 0.15% or above. However, if they are contained excessively, deterioration of workability is caused. Consequently, Cu is to be made 1% or below, preferably 0.8% or below, more preferably 0.5% or below. Ni is to be made 1% or below, preferably 0.8% or below, more preferably 0.5% or below. Each of Cu and Ni may be contained solely, but the effects described above are easily manifested by joint use of Cu and Ni.

[(c) W: 0.01-1%]

W is an element effectively acting for increasing the strength of the thin steel sheet. Also, because precipitates containing W act as the hydrogen trap site, they improve hydrogen embrittlement resistance properties as well. In order to exert such effects effectively, it is favorable to contain W by 0.01% or above, preferably 0.1% or above, and preferably 0.15% or above. However, if it is contained excessively, ductility and workability deteriorate. Accordingly, W is to be made 1% or below, preferably 0.8% or below, more preferably 0.5% or below.

[(d) At Least One Kind Selected from a Group Consisting of Ca: 0.0005-0.005%, Mg: 0.0005-0.005%, and REM: 0.0005-0.005%]

Ca, Mg, REM (rare earth element) are elements acting for inhibiting corroding of the surface of the thin steel sheet to increase hydrogen ion concentration (that means, to inhibit lowering of pH) of the interface atmosphere and enhancing corrosion resistance of the thin steel sheet. Also, they act for controlling the form of sulfide in the thin steel sheet and enhancing workability. In order to exert such effects effectively, it is preferable to contain, in any case of Ca, Mg, REM, by 0.0005% or above, preferably 0.001% or above. However, if they are contained excessively, workability deteriorates, and therefore, in any case of Ca, Mg, REM, it is favorable to inhibit to 0.005% or below, preferably 0.004% or below.

Because the hot-rolled steel sheet for cold-rolling of the present invention satisfying the componential composition described above contains the quenchability improving elements in good balance, the structure of the hot-rolled steel sheet becomes a structure composed mainly of ferrite and pearlite. As a result, the hot-rolled strength is inhibited to 900 MPa or below, and excellent cold-rollability can be obtained. On the other hand, by conducting the heat treatment described later after cold-rolling, quenchability of B is exerted and the thin steel sheet with 980 MPa or above tensile strength can be obtained.

In the thin steel sheet of the present invention, in an area ratio against all the structure, (i) the total of bainitic ferrite (BF) and martensite (M) is 80% or above, (ii) retained austenite (retained γ) is 1% or above, and (iii) a mean axis ratio (major axis/minor axis) of the retained austenite crystal grain is 5 or above. The reasons of stipulation of each structure in the present invention will be described below in detail.

(i) In the present invention, as described above, the structure of the thin steel sheet is to be made two-phase structure of bainitic ferrite and martensite (may be hereinafter referred to as "BF-M structure"). In particular, it is to be made two-phase structure composed mainly of bainitic ferrite. The BF-M structure is hard, and high strength can be obtained easily. Also, in the BF-M structure, as the result that the dislocation density of the base phase is high and much hydrogen is trapped on the dislocation, there is a merit that more hydrogen can be absorbed compared, for example, with such a TRIP steel as with a base phase of polygonal ferrite. Further, there is also a merit that, in the boundary of the lath-like bainitic ferrite, the lath-like retained austenite stipulated in the present invention is easily formed and very excellent elongation can be obtained.

In order to exert such actions effectively, in an area ratio against all the structure, the total of bainitic ferrite and martensite is to be made 80% or above, preferably 85% or above, more preferably 90% or above. The upper limit of bainitic ferrite and martensite is determined by the balance with other structure (retained austenite, for example), and in the case that the structure other than the retained austenite (ferrite or the like, for example) described later is not contained, the upper limit is controlled to 99%.

The bainitic ferrite referred to in the present invention means the lower structure which is sheet-like ferrite with high dislocation density. Also, bainitic ferrite and polygonal ferrite having the lower structure wherein there is no dislocation or dislocation is very rare are distinguished clearly by SEM observation. That means, bainitic ferrite shows dark gray in a SEM photograph, whereas polygonal ferrite looks black and lump-like in a SEM photograph.

The area ratio of the BF-M structure is obtained as follows. That means, it is calculated by corroding the thin steel sheet by nital, and observing an optional measurement area (approximately 50×50 μm, 0.1 μm of the measurement interval) in the plane parallel to the rolling face in the ¼ position of the sheet thickness by a high-resolution type FE-SEM (Field Emission type Scanning Electron Microscope; XL30S-FEG, made by Philips Electron Optics) equipped with an EBSP (Electron Back Scatter diffraction Pattern) detector.

Although there is a case that the BF-M structure and retained austenite cannot be dividingly distinguished by a SEM photograph, according to the method described above, the area observed by a SEM can be analyzed by the EBSP detector simultaneously at the site, and there is a merit that dividingly distinguishing the BF-M structure and retained austenite is possible. The observation magnification can be made 1,500 times.

Here, the EBSP method will be described briefly. In the EBSP, an electron beam is made incident onto the sample surface, and the crystal orientation of the electron beam incident position is determined by analyzing the Kikuchi-pattern obtained from the reflected electron generated then, wherein, if the electron beam is scanned two-dimensionally on the sample surface and the crystal orientation is measured on each predetermined pitch, orientation distribution of the sample surface can be measured. According to this EBSP observation, there is a merit that the structure in the sheet thickness direction with different crystal orientation difference which is the structure judged to be same in ordinary microscopic observation can be distinguished by difference in color tone.

(ii) Retained austenite is not only useful in improving the total elongation, but also it largely contributes to improvement of hydrogen embrittlement resistance properties. In the thin steel sheet of the present invention, the retained austenite is to be made exist by 1% or above, preferably 3% or above, more preferably 5% or above. However, if the retained austenite exists much, the desired high strength cannot be secured, therefore, it is recommended to make its upper limit 15% (more preferably 10%).

(iii) If the retained austenite is made lath-like, the hydrogen trap capacity becomes overwhelmingly larger than that of carbides, and when its shape is with 5 or above mean axis ratio (major axis/minor axis) in particular, hydrogen infiltrating in by so-called atmospheric corrosion is made essentially harmless, and hydrogen embrittlement resistance properties can be improved remarkably. The mean axis ratio of the retained austenite is preferably 10 or above, more preferably 15 or above. On the other hand, although the upper limit of the mean axis ratio described above is not particularly stipulated from a viewpoint of improving hydrogen embrittlement resistance properties, thickness of the retained austenite is necessary to some extent in order to exert TRIP effect effectively. When this point is taken into consideration, the upper limit is preferably to be made 30, and 20 or below is more preferable.

Retained austenite means the region observed as an fcc phase (face-centered cubic lattice) using a high resolution type FE-SEM equipped with an EBSP detector described above. A specific example of measurement according to EBSP will be described. The object of observation is to be made the same measurement area where observation of the bainitic ferrite and martensite described above was performed, that is, the optional measurement area (approximately 50×50 μm, 0.1 μm of the measurement interval) in the plane parallel to the rolling face in the ¼ position of the sheet thickness. However, in polishing to the measurement face concerned, electrolytic polishing is preferable in order to prevent transformation of the retained austenite by mechanical polishing. Next, an electron beam is irradiated to the sample set within a lens-barrel of the SEM using a high resolution type FE-SEM equipped with an EBSP detector. An EBSP image projected onto a screen is photographed by a high-sensitivity camera (VE-1000-SIT, made by Dage-MTI Inc.), and is fetched to a computer as an image. Then, image analysis is conducted by the computer, and the fcc phase determined by comparison with a pattern by simulation using a known crystal series [fcc phase (face-centered cubic lattice) in the case of retained austenite] is made a color map. The area ratio of the area mapped thus is obtained, which is stipulated as the area ratio of the retained austenite. Also, in the present invention, as a hardware and software related with the analysis described above, the OIM (Orientation Imaging Microscopy™) system of TexSEM Laboratories Inc. was used.

Further, measurement of the mean axis ratio of the retained austenite crystal grain was performed by conducting observation by a TEM (Transmission Electron Microscope) with 15,000 times magnification, measuring the major axis and minor axis of the retained austenite crystal grain existing in optionally selected three fields of view (one field of view was 8 μm×8 μm), obtaining the axis ratio (major axis/minor axis), calculating their average, and making it the mean axis ratio.

Although the thin steel sheet of the present invention may be constituted of the mixed structure of bainitic ferrite, martensite, and retained austenite, it may contain other structure (typically, ferrite and pearlite) within a range wherein the actions of the present invention are not impaired. The ferrite referred to here means polygonal ferrite. In other words, it means the ferrite whose dislocation density is null or very rare.

Ferrite and pearlite are the structures which are possible to be retained inevitably in the manufacturing process of the present invention. The less these structures are, the more preferable they are, and, in the present invention, it is preferable to inhibit them to 9% or below, more preferably below 5%, further more preferably below 3%.

The thin steel sheet of the present invention can be manufactured by obtaining the hot-rolled steel sheet by hot-rolling of a slab satisfying the componential composition described previously, thereafter obtaining the cold-rolled steel sheet by cold-rolling, and then, heat-treating the cold-rolled steel sheet.

In order to obtain a hot-rolled steel sheet excellent in cold-rollability, in the coiling step, the coiling temperature is to be made 550-800° C. Thus, cold-rolling becomes easy, as the structure of the hot-rolled steel sheet becomes the structure composed mainly of ferrite and pearlite and the strength of the hot-rolled steel sheet is inhibited to 900 MPa or below. If the coiling temperature is below 550° C., a hard phase of bainite, martensite or the like is formed, the strength becomes high, and cold-rollability cannot be improved. Accordingly, the coiling temperature is 550° C. or above, preferably 600° C. or above. Also, the upper limit of the coiling temperature is not particularly limited, however it is to be made 800° C. due to the restriction on facilities. The coiling temperature is preferably 750° C. or below, more preferably 700° C. or below.

The hot-rolling condition before coiling is not limited in particular as far as the coiling temperature can be adjusted to the range described above, for example, the slab obtained by casting is hot-rolled with the finishing temperature of 850-950° C. as casted or after heating to approximately 1,150-1,300° C., then can be cooled at a cooling speed of 0.1-1,000° C./s to the coiling temperature described above.

According to the present invention, the slab whose componential composition has been adjusted is hot-rolled and is coiled at a predetermined temperature, therefore, the strength of the hot-rolled steel sheet can be inhibited to 900 MPa or below. Accordingly, the hot-rolled steel sheet of the present invention is useful as non-heat treated material which can be cold-rolled without tempering (refinement treatment) after hot-rolling, which can improve the productivity.

The cold-rolling condition after hot-rolling is not limited in particular, and the hot-rolled steel sheet can be cold-rolled by an ordinary method. Cold-rolling ratio is recommendable to be 1-70%. The reason is that, in the cold-rolling with the cold-rolling ratio exceeding 70%, the rolling load increases and rolling becomes difficult.

With respect to the heat treatment condition after cold-rolling, it is recommended that, after the cold-rolled steel sheet satisfying the componential composition described previously is maintained for 10-1,800 s (t1) at the temperature of $A_{c3}$ point−($A_{c3}$ point+50° C.) (T1), it is cooled to the temperature of ($M_s$ point−100° C.) to $B_s$ point (T2) at the average cooling speed of 3° C./s or above, and is maintained for 60-1,800 s (t2) at the temperature range.

If T1 described above exceeds the temperature of ($A_{c3}$ point+50° C.) or t1 exceeds 1,800 s, grain growth of austenite is caused and workability (stretch-flange formability) deteriorates, which is not preferable. Accordingly, t1 is 1,800 s or shorter, preferably 600 s or shorter, more preferably 400 s or shorter.

On the other hand, if T1 described above becomes lower than the temperature of $A_{c3}$ point, the prescribed bainitic ferrite and martensite structure cannot be obtained. Also, if t1 described above is shorter than 10 s, austenitizing is not performed sufficiently and carbonite of Fe (cementite) and carbonite of other alloy remain, which is not preferable. Accordingly, t1 is 10 s or longer, preferably 30 s or longer, more preferably 60 s or longer.

$A_{c3}$ point can be calculated by the calculation formula shown below which is described in p. 273 of "The Physical Metallurgy of Steels" by Leslie.

$$A_{c3}=910-203\times[C]^{0.5}-15.2\times[Ni]+44.7\times[Si]+104\times[V]+31.5\times[Mo]+13.1\times[W]-30\times[Mn]-11\times[Cr]-20\times[Cu]+700\times[P]+400\times[Al]+400\times[Ti]$$

Then, by cooling the cold-rolled steel sheet described above at the average cooling speed of 3° C./s or faster, pearlite transformation region can be avoided and formation of pearlite structure can be prevented. The faster this average cooling speed is, the more preferable it is, and it is recommended to make it preferably 5° C./s or faster, more preferably 10° C./s or faster.

The cooling arrival temperature is to be made a temperature of ($M_s$, point−100° C.) to $B_s$ point (T2), and the prescribed structure can be formed by being maintained for 60-1,800 s (t2) in this temperature range for isothermal transformation. If T2 (maintaining temperature) exceeds the temperature of $B_s$ point, pearlite which is not preferable for the present invention is formed much, and bainitic ferrite and martensite structure cannot be secured sufficiently. On the other hand, if T2 is lower than the temperature of ($M_s$ point−100° C.), the retained austenite decreases which is not preferable.

$M_s$ point can be calculated by the calculation formula shown below.

$$M_s=561-474\times[C]-33\times[Mn]-17\times[Ni]-17\times[Cr]-21\times[Mo]$$

$B_s$ point can be calculated by the calculation formula shown below.

$$B_s=830-270\times[C]-90\times[Mn]-37\times[Ni]-70\times[Cr]-83\times[Mo]$$

Also, if t2 (maintaining time) exceeds 1,800 s, the dislocation density of bainitic ferrite becomes low, the trapping amount of hydrogen becomes little, and prescribed retained austenite cannot be obtained. Accordingly, t2 described above is to be made 1,800 s or shorter, preferably 1,200 s or shorter, more preferably 600 s or shorter.

On the other hand, if t2 described above is shorter than 60 s, prescribed bainitic ferrite and martensite structure cannot be obtained also. Accordingly, t2 described above is to be made preferably 60 s or longer, preferably 90 s or longer, more preferably 120 s or longer.

The cooling method after maintaining is not particularly limited, and air cooling, rapid cooling, gas and water cooling, or the like can be conducted.

If the actual operation is considered, the heat treatment described above (annealing treatment) is conveniently conducted using a continuous type annealing device or a batch type annealing device. Also, when the cold-rolled steel plate is subjected to plating and is made hot-dip galvanized plating, the plating condition may be set so as to satisfy the heat treatment condition described above, and the plating step is conducted concurrently for the heat treatment described above.

Although the object of the present invention is the thin steel sheet with the sheet thickness of 5 mm or below, its product form is not particularly limited, and the thin steel sheet obtained through hot-rolling, cold-rolling, and heat treatment (annealing treatment) may be subjected to chemical treatment, plating by hot-dip plating, electroplating, vapor depositing, or the like, a variety of coating, coating substrate treatment, organic film treatment, or the like.

With respect to the kind of plating described above, any of general zinc plating, aluminum plating, or the like is possible as well. Also, with respect to the plating method, either of hot-dip plating and electroplating is possible, and also, alloying heat treatment can be conducted after plating, and further, double-layer plating can be conducted as well. Furthermore, film laminate treatment also can be conducted on a non-plated steel sheet and on a plated steel sheet.

In conducting coating described above, chemical treatment such as phosphate treatment may be conducted and electrodeposition coating may be conducted according to a variety of uses. With respect to coating material, publicly known resin can be used, and, for example, an epoxy resin, a fluorine-containing resin, a silicone acrylic resin, a polyurethane resin, an acrylic resin, a polyester resin, a phenolic resin, an alkyd resin, a melamine resin, or the like can be used along with a publicly known hardener. In particular, from the viewpoint of corrosion resistance property, use of an epoxy resin, a fluorine-containing resin, a silicone acrylic resin is recommended. In addition, publicly known additives of, for example, coloring pigments, a coupling agent, a leveling agent, a sensitizer, an antioxidant, a ultraviolet ray stabilizer, a fire retarder, or the like added to coating material may be added.

Further, the form of the coating material also is not particularly limited, and a solvent based coating material, a powder coating material, a water based coating material, an aqueous dispersion type coating material, an electrodeposition coating material, or the like can be suitably selected according to the use. In order to form a desired coating layer on the steel using the coating material described above, a publicly known method such as a dipping method, a roll coater method, a spray method, a curtain flow coater method, or the like can be used. A publicly known appropriate value can be adopted for the thickness of the coating layer according to the use.

Because the strength of the thin steel sheet of the present invention is high, it can be applied to, for example, a strength part for an automobile such as a reinforcing member of the automobile such as a bumper, a door impact beam, a pillar, a reinforce, a member, or the like, and an indoor part such as a seat rail, or the like as well. Even in the part obtained by forming and fabricating thus, sufficient material characteristic (strength) is given and can exert excellent hydrogen embrittlement resistance properties are exerted.

EXAMPLES

Although the present invention will be described below more specifically referring to examples, the present invention is not to be limited by the examples described below, and can be implemented with modifications added appropriately within the scope adaptable to the purposes described previously and later, and any of them is to be included within the technical range of the present invention.

The steel to be tested (steel kinds A-U and steel kinds a-r) with the componential composition shown in Table 1 or Table 2 (balance was iron with inevitable impurities) was melted in vacuum and was made a slab for experimental use, the surface scale was thereafter removed by acid pickling after obtaining the hot-rolled steel sheet with 3.2 mm thickness, and then, the steel sheet was cold-rolled until it became of 1.2 mm thickness and was subjected to continuous annealing. The conditions of the hot-rolling step, cold-rolling step and annealing step were as follows. The temperature of $A_{c3}$ point, the temperature of $B_s$ point, the temperature of $M_s$ point were respectively calculated using the formula described above from the componential composition, and were shown in Table 1 and Table 2 below. Also, the values Z calculated using the equation (1) described above from the componential composition shown in Table 1 and Table 2 were shown in Table 3 and Table 4 below.

In the hot-rolling step, the slab for experimental use described above was maintained for 30 min at 1,250° C., thereafter, was hot-rolled so that the finishing temperature (FDT) became 850° C., and was cooled to the coiling temperature (500-650° C.) at 40° C./s average cooling speed. Then, after maintaining for 30 min at this coiling temperature, it was let to cool to room temperature and the hot-rolled steel sheet was obtained.

The hot-rolled steel sheet obtained was cold-rolled with the cold-rolling ratio of 50% (cold-rolling step), and was then subjected to continuous annealing (annealing step). The continuous annealing was conducted by maintaining at the temperature T1 (° C.) for 120 s (t1), thereafter cooling rapidly (air cooling) at the average cooling speed of 20° C./s to the temperature T2 (° C.) shown in Table 3 or Table 4, and maintained at the temperature T2 (° C.) for 240 s (t2). After maintaining at the temperature T2, it was subjected to gas and water cooling to room temperature, and the thin steel sheet was obtained.

The tensile strength (TS) and cold-rollability of the hot-rolled steel sheet, the tensile strength of the thin steel sheet, the metallic structure of the thin steel sheet, and hydrogen embrittlement resistance properties of the thin steel sheet thus obtained were respectively investigated in the manner described below.

[Tensile Strength (TS) and Cold-Rollability of Hot-Rolled Steel Sheet]

The tensile strength (TS) of the hot-rolled steel sheet was measured by conducting the tensile test using JIS No. 5 test piece as a test piece. The strain rate of the tensile test was made 1 mm/s. The case wherein the tensile strength of the hot-rolled steel sheet was 900 MPa or below was evaluated to be excellent in cold-rollability which was shown with o in Table 3 and Table 4 below. On the other hand, the case exceeding 900 MPa was evaluated to be inferior in cold-rollability and was shown with x in Table 3 and Table 4 below.

[Tensile Strength (TS) of Thin Steel Sheet]

The tensile strength (TS) of the thin steel sheet was measured also by conducting the tensile test using JIS No. 5 test piece as a test piece. The strain rate of the tensile test was made 1 mm/s also. The case wherein the tensile strength of the thin steel sheet was 980 MPa or above was evaluated to be of high strength (passed), and the case below 980 MPa was evaluated to be insufficient strength (failed).

[Metallic Structure of Thin Steel Sheet]

Observation and photographing were conducted with the object of the optional measurement area (approximately 50 μm×50 μm, 0.1 μm of the measurement interval) in the plane parallel to the rolling face in the ¼ position of the thin steel sheet thickness, and the area ratio of bainitic ferrite (BF) and area ratio of martensite (M), and the area ratio of retained austenite (retained γ) were measured according to the method described previously. In optionally selected two fields of view with the size described above, measuring was conducted in the same manner, and the average value was obtained.

The area ratio of the other structure (ferrite, pearlite, or the like) was obtained by deducting the area ratio of the structure described above (BF+M+retained γ) from the total area (100%).

The mean axis ratio of the retained austenite crystal grain was measured according to the method described previously, and those with 5 or above mean axis ratio were evaluated to be satisfying the purpose of the present invention (o), whereas those with below 5 mean axis ratio were evaluated not to be satisfying the purpose of the present invention (x).

[Hydrogen Embrittlement Resistance Properties of Thin Steel Sheet]

In measuring the hydrogen embrittlement resistance properties, a rectangular test piece of 150 mm×30 mm was cut out from each thin steel sheet and was made the test piece. That means, one, wherein two holes (ϕ12 mm) for inserting a bolt were drilled in the rectangular test piece cut out as shown in (a) of FIG. 1, bending work was conducted so that R of the bending part became 15 mm as shown in (b) of FIG. 1, thereafter a bolt 1 was inserted to the holes described above for fastening, and the stress of 1,000 MPa was loaded to the bending part, was used as the test piece. The stress of the bending part was adjusted by adhering a strain gauge 2 onto the bending part prior to fastening the test piece, which had been subjected to bending work, by the bolt 1, tightening the bolt 1 thereafter until the stress loaded to the bending part became 1,000 MPa. This test piece was dipped in the 5% hydrochloric aqueous solution, and the time until occurrence of the crack was measured. The thin steel sheet wherein the time until occurrence of crack was 24 hours or longer was evaluated to be excellent in hydrogen embrittlement resistance properties, and the thin steel sheet wherein the time until occurrence of crack was shorter than 24 hours was evaluated to be inferior in hydrogen embrittlement resistance properties.

Above results are shown in Table 3 and Table 4 side by side.

TABLE 1

| | Componential composition (mass %) | | | | | | | | | | | | | | Ac3 | Bs | Ms |
|---|---|---|---|---|---|---|---|---|---|---|---|---|---|---|---|---|---|
| Steel kind | C | Si | Mn | P | S | Al | Cu | Ni | Mo | Nb | Ti | B | N | Others | (° C.) | (° C.) | (° C.) |
| A | 0.18 | 1.5 | 2.5 | 0.007 | 0.002 | 0.045 | — | — | 0.01 | — | 0.05 | 0.0020 | 0.002 | | 859 | 556 | 393 |
| B | 0.18 | 1.5 | 2.5 | 0.007 | 0.002 | 0.045 | 0.3 | 0.2 | 0.02 | 0.05 | 0.05 | 0.0020 | 0.002 | | 850 | 547 | 389 |
| C | 0.18 | 1.5 | 2.5 | 0.007 | 0.002 | 0.045 | 0.3 | 0.2 | 0.05 | 0.05 | 0.05 | 0.0020 | 0.002 | | 851 | 545 | 389 |
| D | 0.18 | 1.5 | 2.5 | 0.007 | 0.002 | 0.045 | 0.3 | 0.2 | 0.01 | 0.05 | 0.05 | 0.0008 | 0.002 | | 850 | 548 | 390 |
| E | 0.18 | 1.5 | 2.5 | 0.007 | 0.002 | 0.045 | 0.3 | 0.2 | 0.02 | 0.05 | 0.05 | 0.0008 | 0.002 | | 850 | 547 | 389 |
| F | 0.18 | 1.5 | 2.5 | 0.007 | 0.002 | 0.045 | 0.3 | 0.2 | 0.05 | 0.05 | 0.05 | 0.0008 | 0.002 | | 851 | 545 | 389 |
| G | 0.18 | 1.5 | 2.5 | 0.007 | 0.002 | 0.045 | 0.3 | 0.2 | 0.01 | 0.05 | 0.07 | 0.0020 | 0.002 | | 858 | 548 | 390 |
| H | 0.18 | 1.5 | 2.5 | 0.007 | 0.002 | 0.045 | 0.3 | 0.2 | 0.05 | 0.05 | 0.07 | 0.0020 | 0.002 | | 859 | 545 | 389 |
| I | 0.18 | 1.5 | 2.5 | 0.007 | 0.002 | 0.045 | 0.3 | 0.2 | 0.01 | 0.05 | 0.07 | 0.0008 | 0.002 | | 858 | 548 | 390 |
| J | 0.12 | 1.5 | 2.5 | 0.007 | 0.002 | 0.045 | 0.3 | 0.2 | 0.01 | 0.05 | 0.05 | 0.0020 | 0.002 | | 866 | 564 | 418 |
| K | 0.15 | 1.5 | 2.5 | 0.007 | 0.002 | 0.045 | 0.3 | 0.2 | 0.01 | 0.05 | 0.05 | 0.0020 | 0.002 | | 858 | 556 | 404 |
| L | 0.18 | 1.5 | 2.5 | 0.007 | 0.002 | 0.045 | — | — | 0.01 | — | 0.05 | 0.0034 | 0.002 | | 859 | 556 | 393 |
| M | 0.28 | 1.5 | 2.5 | 0.007 | 0.002 | 0.045 | 0.3 | 0.2 | 0.01 | 0.05 | 0.05 | 0.0020 | 0.002 | | 829 | 521 | 342 |
| N | 0.21 | 1.5 | 2.7 | 0.007 | 0.002 | 0.045 | 0.3 | 0.2 | 0.01 | 0.05 | 0.05 | 0.0023 | 0.002 | | 837 | 522 | 369 |
| O | 0.18 | 0.4 | 2.5 | 0.007 | 0.002 | 0.045 | 0.3 | 0.2 | 0.01 | 0.05 | 0.05 | 0.0020 | 0.002 | | 801 | 548 | 390 |
| P | 0.18 | 2 | 2.5 | 0.007 | 0.002 | 0.045 | 0.3 | 0.2 | 0.01 | 0.05 | 0.05 | 0.0020 | 0.002 | | 872 | 548 | 390 |
| Q | 0.18 | 1.5 | 1.5 | 0.007 | 0.002 | 0.045 | 0.3 | 0.2 | 0.01 | 0.05 | 0.05 | 0.0020 | 0.002 | | 880 | 638 | 423 |
| R | 0.18 | 1.5 | 3.6 | 0.007 | 0.002 | 0.045 | 0.3 | 0.2 | 0.01 | 0.05 | 0.05 | 0.0020 | 0.002 | | 817 | 449 | 353 |
| S | 0.18 | 1.5 | 2.5 | 0.007 | 0.002 | 0.045 | 0.3 | 0.2 | 0.01 | — | 0.05 | 0.0020 | 0.002 | | 850 | 548 | 390 |
| T | 0.18 | 1.5 | 2.5 | 0.007 | 0.002 | 0.045 | 0.3 | 0.2 | 0.01 | 0.05 | 0.05 | 0.0020 | 0.002 | Cr: 0.2 | 848 | 534 | 386 |
| U | 0.18 | 1.5 | 2.5 | 0.007 | 0.002 | 0.045 | 0.3 | 0.2 | 0.01 | 0.05 | 0.05 | 0.0020 | 0.002 | V: 0.2 | 871 | 548 | 390 |

TABLE 2

| | Componential composition (mass %) | | | | | | | | | | | | | | Ac3 | Bs | Ms |
|---|---|---|---|---|---|---|---|---|---|---|---|---|---|---|---|---|---|
| Steel kind | C | Si | Mn | P | S | Al | Cu | Ni | Mo | Nb | Ti | B | N | Others | (° C.) | (° C.) | (° C.) |
| a | 0.18 | 1.5 | 2.5 | 0.007 | 0.002 | 0.045 | 0.3 | 0.2 | 0.01 | 0.05 | 0.05 | 0.0020 | 0.002 | W: 0.2 | 853 | 548 | 390 |
| b | 0.18 | 1.5 | 2.5 | 0.007 | 0.002 | 0.045 | 0.3 | 0.2 | 0.01 | 0.05 | 0.05 | 0.0020 | 0.002 | Ca: 0.002 | 850 | 548 | 390 |
| c | 0.18 | 1.5 | 2.5 | 0.007 | 0.002 | 0.045 | 0.3 | 0.2 | 0.01 | 0.05 | 0.05 | 0.0020 | 0.002 | Mg: 0.002 | 850 | 548 | 390 |
| d | 0.18 | 1.5 | 2.5 | 0.007 | 0.002 | 0.045 | 0.2 | 0.1 | 0.01 | 0.03 | 0.05 | 0.0020 | 0.002 | | 854 | 552 | 391 |
| e | 0.18 | 1.5 | 2.5 | 0.007 | 0.002 | 0.045 | — | — | 0.01 | 0.05 | 0.05 | 0.0020 | 0.002 | | 859 | 556 | 393 |
| f | 0.19 | 1.5 | 2.5 | 0.007 | 0.002 | 0.045 | 0.3 | 0.2 | 0.2 | 0.05 | 0.05 | — | 0.002 | | 854 | 530 | 381 |
| g | 0.19 | 1.5 | 2.5 | 0.007 | 0.002 | 0.045 | 0.3 | 0.2 | 0.1 | 0.05 | 0.05 | — | 0.002 | | 851 | 538 | 383 |
| h | 0.19 | 1.5 | 2 | 0.007 | 0.002 | 0.045 | 0.3 | 0.2 | 0.2 | 0.05 | 0.05 | — | 0.002 | Cr: 0.7 | 869 | 575 | 397 |
| i | 0.19 | 1.5 | 2.5 | 0.007 | 0.002 | 0.045 | 0.2 | 0.1 | 0.2 | 0.05 | 0.05 | — | 0.002 | | 857 | 533 | 383 |
| j | 0.19 | 1.5 | 2.5 | 0.007 | 0.002 | 0.1 | 0.3 | 0.2 | 0.2 | 0.05 | 0.05 | — | 0.002 | | 876 | 530 | 381 |
| k | 0.19 | 1.5 | 2.5 | 0.007 | 0.002 | 0.045 | 0.3 | 0.2 | 0.09 | 0.02 | 0.05 | — | 0.002 | | 850 | 539 | 383 |
| l | 0.25 | 1.5 | 2.5 | 0.008 | 0.007 | 0.04 | 0.32 | 0.85 | 0.23 | 0.015 | — | — | 0.002 | | 806 | 487 | 341 |
| m | 0.19 | 1.8 | 2.5 | 0.007 | 0.002 | 0.045 | 0.3 | 0.2 | 0.01 | 0.05 | 0.05 | 0.0020 | 0.002 | | 861 | 545 | 385 |
| n | 0.18 | 0.8 | 3.0 | 0.007 | 0.002 | 0.045 | — | — | — | — | 0.02 | 0.0015 | 0.002 | | 801 | 511 | 377 |
| o | 0.17 | 1.2 | 2.4 | 0.010 | 0.006 | 0.053 | — | — | — | — | 0.06 | 0.0004 | 0.002 | | 860 | 568 | 401 |
| p | 0.17 | 1.8 | 2.3 | 0.008 | 0.001 | 0.063 | — | — | — | — | 0.03 | 0.0012 | 0.002 | Cr: 0.45 | 881 | 577 | 405 |
| q | 0.11 | 1.2 | 0.9 | 0.008 | 0.001 | 0.054 | — | — | — | — | 0.04 | — | 0.002 | | 913 | 719 | 479 |
| r | 0.14 | 1.4 | 1.2 | 0.010 | 0.004 | 0.036 | 0.3 | 0.2 | — | — | 0.08 | 0.0003 | 0.002 | Cr: 0.42 | 900 | 647 | 445 |

TABLE 3

| No. | Steel kind | Value Z | Coiling temperature (° C.) | Strength of hot-rolled steel sheet (MPa) | Cold-rollability | T1 (° C.) | T2 (° C.) | Strength of thin steel sheet (MPa) | Structure of thin steel sheet (area %) BF + M | Retained γ | Others | Mean axis ratio of retained γ Value | Evaluation | Hydrogen embrittlement resistance properties (hr) |
|---|---|---|---|---|---|---|---|---|---|---|---|---|---|---|
| 1 | A | 5.36 | 650 | 830 | ○ | 900 | 300 | 1421 | 95 | 5 | 0 | 18 | ○ | Over 24 |
| 2 | B | 5.63 | 650 | 860 | ○ | 900 | 300 | 1465 | 95 | 5 | 0 | 20 | ○ | Over 24 |
| 3 | C | 6.42 | 650 | 1000 | x | 900 | 300 | 1490 | 94 | 6 | 0 | 16 | ○ | Over 24 |
| 4 | D | 4.93 | 650 | 820 | ○ | 900 | 300 | 1420 | 94 | 6 | 0 | 23 | ○ | Over 24 |
| 5 | E | 5.35 | 650 | 850 | ○ | 900 | 300 | 1435 | 94 | 6 | 0 | 20 | ○ | Over 24 |
| 6 | F | 6.61 | 650 | 980 | x | 900 | 300 | 1480 | 93 | 7 | 0 | 21 | ○ | Over 24 |
| 7 | G | 5.36 | 650 | 820 | ○ | 900 | 300 | 1430 | 94 | 6 | 0 | 17 | ○ | Over 24 |
| 8 | H | 6.42 | 650 | 980 | x | 900 | 300 | 1480 | 93 | 7 | 0 | 22 | ○ | Over 24 |
| 9 | I | 4.93 | 650 | 850 | ○ | 900 | 300 | 1450 | 95 | 5 | 0 | 20 | ○ | Over 24 |
| 10 | J | 4.82 | 650 | 650 | ○ | 900 | 320 | 1130 | 97 | 3 | 0 | 14 | ○ | Over 24 |
| 11 | K | 5.09 | 650 | 780 | ○ | 900 | 320 | 1300 | 96 | 4 | 0 | 15 | ○ | Over 24 |
| 12 | L | 5.98 | 650 | 820 | ○ | 900 | 300 | 1430 | 95 | 5 | 0 | 22 | ○ | 18 |
| 13 | M | 6.26 | 650 | 910 | x | 850 | 300 | 1640 | 91 | 9 | 0 | 25 | ○ | 10 |
| 14 | N | 5.96 | 650 | 885 | ○ | 850 | 300 | 1605 | 92 | 8 | 0 | 26 | ○ | Over 24 |
| 15 | O | 5.36 | 650 | 790 | ○ | 850 | 300 | 1435 | 99 | <1 | 1< | Unmeasurable | x | 9 |
| 16 | P | 5.36 | 650 | 840 | ○ | 900 | 300 | 1460 | 91 | 8 | 1 | 19 | ○ | Over 24 |
| 17 | Q | 4.36 | 650 | 720 | ○ | 900 | 340 | 1300 | 96 | 4 | 0 | 9 | ○ | Over 24 |
| 18 | R | 6.46 | 650 | 940 | x | 850 | 300 | 1540 | 94 | 6 | 0 | 17 | ○ | 6 |
| 19 | S | 5.36 | 650 | 850 | ○ | 900 | 300 | 1470 | 95 | 5 | 0 | 19 | ○ | Over 24 |
| 20 | T | 5.36 | 650 | 870 | ○ | 850 | 300 | 1520 | 95 | 5 | 0 | 20 | ○ | Over 24 |
| 21 | U | 5.36 | 650 | 890 | ○ | 900 | 300 | 1540 | 94 | 6 | 0 | 20 | ○ | Over 24 |

TABLE 4

| No. | Steel kind | Value Z | Coiling temperature (° C.) | Strength of hot-rolled steel sheet (MPa) | Cold-rollability | T1 (° C.) | T2 (° C.) | Strength of thin steel sheet (MPa) | Structure of thin steel sheet (area %) BF + M | Retained γ | Others | Mean axis ratio of retained γ Value | Evaluation | Hydrogen embrittlement resistance properties (hr) |
|---|---|---|---|---|---|---|---|---|---|---|---|---|---|---|
| 22 | a | 5.36 | 650 | 880 | ○ | 900 | 300 | 1500 | 94 | 6 | 0 | 19 | ○ | Over 24 |
| 23 | b | 5.36 | 650 | 835 | ○ | 900 | 300 | 1460 | 95 | 5 | 0 | 21 | ○ | Over 24 |
| 24 | c | 5.36 | 650 | 838 | ○ | 900 | 300 | 1465 | 95 | 5 | 0 | 20 | ○ | Over 24 |
| 25 | d | 5.36 | 650 | 795 | ○ | 900 | 300 | 1445 | 94 | 6 | 0 | 19 | ○ | Over 24 |
| 26 | e | 5.36 | 650 | 760 | ○ | 900 | 300 | 1225 | 95 | 5 | 0 | 16 | ○ | Over 24 |
| 27 | f | 18.81 | 650 | 1285 | x | 900 | 300 | 1456 | 94 | 6 | 0 | 20 | ○ | Over 24 |
| 28 | g | 11.51 | 650 | 1125 | x | 900 | 300 | 1415 | 94 | 6 | 0 | 20 | ○ | Over 24 |
| 29 | h | 18.31 | 650 | 1220 | x | 900 | 300 | 1380 | 94 | 6 | 0 | 19 | ○ | Over 24 |
| 30 | i | 18.81 | 650 | 1200 | x | 900 | 300 | 1440 | 95 | 5 | 0 | 22 | ○ | Over 24 |
| 31 | j | 18.81 | 650 | 1250 | x | 900 | 300 | 1420 | 94 | 6 | 0 | 23 | ○ | Over 24 |
| 32 | k | 10.78 | 650 | 1180 | x | 900 | 300 | 1470 | 94 | 6 | 0 | 21 | ○ | Over 24 |
| 33 | l | 21.54 | 650 | 1300 | x | 850 | 300 | 1385 | 90 | 10 | 0 | 18 | ○ | Over 24 |
| 34 | m | 5.45 | 650 | 850 | ○ | 800 | 300 | 1150 | 62 | 11 | 27 | 1.5 | x | 20 |
| 35 | n | 5.36 | 650 | 880 | ○ | 850 | 400 | 1312 | 95 | 5 | 0 | 14 | ○ | Over 24 |
| 36 | o | 4.13 | 650 | 724 | ○ | 900 | 320 | 1178 | 89 | 4 | 7 | 12 | ○ | Over 24 |
| 37 | p | 4.42 | 650 | 756 | ○ | 900 | 320 | 1358 | 94 | 6 | 0 | 13 | ○ | Over 24 |
| 38 | q | 1.89 | 650 | 563 | ○ | 920 | 380 | 650 | 50 | 4 | 46 | 7 | ○ | Over 24 |
| 39 | r | 2.61 | 650 | 694 | ○ | 920 | 350 | 1012 | 82 | 4 | 14 | 15 | ○ | Over 24 |
| 40 | A | 5.36 | 590 | 887 | ○ | 900 | 300 | 1404 | 92 | 5 | 3 | 18 | ○ | Over 24 |
| 41 | A | 5.36 | 500 | 976 | x | 900 | 300 | 1435 | 95 | 5 | 0 | 20 | ○ | Over 24 |

The following consideration is possible from Table 3 and Table 4. Nos. 1, 2, 4, 5, 7, 9-11, 14, 16, 17, 19-26, 35-37, 39, 40 satisfying the requirements stipulated in the present invention are excellent in cold-rollability as the tensile strength of the hot-rolled steel sheet is 900 MPa or below, can however secure 980 MPa or above tensile strength of the thin steel sheet, and are excellent also in hydrogen embrittlement resistance properties under severe environment.

On the contrary, neither of Nos. 3, 6, 8, 12, 13, 15, 18, 27-34, 38, 41 satisfy the requirements stipulated in the present invention.

Nos. 3, 6, 8 are the examples with the excessive Mo amount, wherein cold-rollability has not been able to be improved because the strength of the hot-rolled steel sheet became high. No. 12 is the example with the excessive B amount, wherein hydrogen embrittlement resistance properties have deteriorated because borocarbides have deposited in the grain boundary and intergranular embrittlement has occurred. No. 13 is the example with the excessive C amount, wherein cold-rollability has not been able to be improved because the strength of the hot-rolled steel sheet became high. Also, the strength of the thin steel sheet became excessively high, and hydrogen embrittlement resistance properties have not been able to be improved sufficiently.

No. 15 is the example with the insufficient amount of Si, wherein retained austenite does not almost exist, and, therefore, is inferior in hydrogen embrittlement resistance properties. No. 18 is the example with the excessive Mn amount, wherein the strength of the hot-rolled steel sheet became high and cold-rollability has not been able to be improved. Also, segregation became extreme and hydrogen embrittlement resistance properties have been deteriorated. Nos. 27-33 are the examples with the excessive Mo amount and not containing B, wherein the strength of the hot-rolled steel sheet became high and cold-rollability has not been able to be improved.

In No. 34, because the temperature T1 was low, annealing took place in the two-phase range of ($\alpha+\gamma$) and ferrite was formed much. Also, the mean axis ratio of the retained austenite crystal grain has not satisfied the range stipulated in the present invention. In No. 38, because the value Z has become smaller than the scope stipulated in the present invention, the strength as the thin steel sheet has not been secured. In No. 41, because the coiling temperature was low, the hard phase such as bainite and martensite was formed, the strength of the hot-rolled steel sheet became high and cold-rollability has not been improved.

INDUSTRIAL APPLICABILITY

Because the high strength thin steel sheet obtained in the present invention shows excellent hydrogen embrittlement resistance properties, it can be suitably used as the raw material of the high strength parts requiring the tensile strength of 980 MPa or above (automobile parts such as reinforcement material such as a bumper and impact beam, and a seat rail, pillar, reinforce, member, for example).

The invention claimed is:

1. A hot-rolled steel sheet for cold-rolling, comprising, in mass %:

C: 0.10-0.25%,
Si: 0.5-3%,
Mn: 1.0-3.2%,
P: 0.1% or below,
S: 0.05% or below,
Al: 0.01-0.1%,
Mo: 0.02% or below,
Ti: 0.005-0.1%,
B: 0.0002-0.0030%,
N: 0.01% or below,
iron and inevitable impurities; wherein
the hot-rolled steel sheet has a value Z calculated by an equation (1) below of 2.0-6.0, and a tensile strength of 900 MPa or below wherein $$\text{Value } Z=9\times[C]+[Mn]+3\times[Mo]+490\times[B]+7\times[Mo]/\{100\times([B]+0.001)\} \quad (1)$$

where [ ] represents a content (mass %) of the respective elements contained in the hot-rolled steel sheet.

2. The hot-rolled steel sheet for cold-rolling as set forth in claim 1, further comprising one or more elements selected from the group consisting of:

Nb: 0.005-0.1%,
V: 0.01-0.5%, and
Cr: 0.01-0.5%.

3. The hot-rolled steel sheet for cold-rolling as set forth in claim 1, further comprising one or more elements of:

Cu: 0.01-1% and
Ni: 0.01-1%.

4. The hot-rolled steel sheet for cold-rolling as set forth in claim 1, further comprising:

W: 0.01-1%.

5. The hot-rolled steel sheet for cold-rolling as set forth in claim 1, further comprising one or more elements selected from the group consisting of:

Ca: 0.0005-0.005%,
Mg: 0.0005-0.005%, and
REM: 0.0005-0.005%.

6. A manufacturing method of a hot-rolled steel sheet for cold-rolling, comprising hot rolling a slab having a composition of the steel sheet according to claim 1 and coiling the slab at 550-800° C. after hot rolling.

7. The hot-rolled steel sheet as set forth in claim 1, consisting essentially of, in mass %:

C: 0.10-0.25%,
Si: 0.5-3%,
Mn: 1.0-3.2%,
P: 0.1% or below,
S: 0.05% or below,
Al: 0.01-0.1%,
Mo: 0.02% or below,
Ti: 0.005-0.1%,
B: 0.0002-0.0030%,
N: 0.01% or below,
Optionally one or more elements selected from the group consisting of 0.01-1% Cu, 0.01-1% Ni, 0.005-0.1% Nb, 0.01-1% W, 0.0005-0.05% Ca, 0.0005-0.005% Mg, 0.01-0.5% V and 0.0005-0.005% REM,
iron and inevitable impurities.

8. A method of manufacturing a cold rolled thin steel sheet, the method comprising cold-rolling the hot-rolled steel sheet according to claim 1 to achieve a tensile strength of 980 MPa or more.

* * * * *